US008991738B2

(12) United States Patent
Niwa et al.

(10) Patent No.: US 8,991,738 B2
(45) Date of Patent: Mar. 31, 2015

(54) WEB WINDING APPARATUS

(71) Applicant: JTEKT Corporation, Osaka-shi (JP)

(72) Inventors: Naohisa Niwa, Nagoya (JP); Yoshihito Fukuda, Nagakute (JP)

(73) Assignee: JTEKT Corporation, Osaka-shi (JP)

( * ) Notice: Subject to any disclaimer, the term of this patent is extended or adjusted under 35 U.S.C. 154(b) by 132 days.

(21) Appl. No.: 13/790,539

(22) Filed: Mar. 8, 2013

(65) Prior Publication Data

US 2013/0248641 A1 Sep. 26, 2013

(30) Foreign Application Priority Data

Mar. 26, 2012 (JP) ..... 2012-069295

(51) Int. Cl.

| | |
|---|---|
| ***B65H 35/06*** | (2006.01) |
| ***B65H 19/26*** | (2006.01) |
| ***B65H 19/28*** | (2006.01) |

(52) U.S. Cl.

CPC ..... *B65H 19/26* (2013.01); *B65H 19/28* (2013.01); *B65H 2301/41398* (2013.01); *B65H 2402/31* (2013.01); *B65H 2402/32* (2013.01); *B65H 2301/418* (2013.01); *B65H 2301/46011* (2013.01); *B65H 2701/1732* (2013.01)

USPC ..... 242/527; 242/527.1; 242/527.2; 242/527.3; 242/527.4

(58) Field of Classification Search

CPC .... B65H 19/26; B65H 19/28; B65H 19/2215; B65H 2301/41894

USPC ..... 242/527, 527.1–527.7

See application file for complete search history.

(56) References Cited

U.S. PATENT DOCUMENTS

| | | | | |
|---|---|---|---|---|
| 3,044,726 | A * | 7/1962 | Schellenberg | 242/527 |
| 4,360,170 | A * | 11/1982 | Kuklies et al. | 242/527 |
| 4,988,052 | A * | 1/1991 | Urban | 242/524.1 |
| 6,220,541 | B1 | 4/2001 | Caprario | |

FOREIGN PATENT DOCUMENTS

| | | |
|---|---|---|
| JP | 9-63565 | 3/1997 |
| JP | 2807857 B2 | 7/1998 |
| JP | 3506818 B2 | 12/2003 |
| WO | WO 94/25382 A1 | 11/1994 |

OTHER PUBLICATIONS

U.S. Appl. No. 13/790,232, filed Mar. 8, 2013, Niwa, et al.
U.S. Appl. No. 13/790,676, filed Mar. 8, 2013, Niwa, et al.
Extended Search Report issued Dec. 5, 2013 in European Application No. 13159363.4.

* cited by examiner

*Primary Examiner* — Sang Kim
(74) *Attorney, Agent, or Firm* — Oblon, McClelland, Maier & Neustadt, L.L.P.

(57) ABSTRACT

The web winding apparatus is characterized in that the two web pressing members are formed such that upon swinging, the two web pressing members move towards an empty one of the two bobbins positioned at one side of the two web pressing members which has been backed away from the cutter and upon swinging, the one of the two web pressing members which has approached the cutter presses an end portion of the web which is to be cut by the cutter on the empty bobbin thereby to wind the end portion of the web on the empty bobbin.

5 Claims, 11 Drawing Sheets

WEB WINDING APPARATUS

INCORPORATION BY REFERENCE

This application is based on and claims priority under 35 U.S.C. 119 with respect to Japanese Application No. 2012-069295 filed on Mar. 26, 2012, the entire content of which is incorporated herein by reference.

BACKGROUND OF THE INVENTION

1. Field of the Invention

This invention relates to a web winding apparatus which winds up a web thereon by cutting the web under transferring operation and winding a cut end portion thereof on an empty bobbin.

2. Description of Related Art

As an example of the related arts, in a web winding apparatus disclosed in JP2807857B (JP7-101604A), a rotatable disc shaped turret is provided and a pair of empty bobbins is detachably and rotatably supported on this turret with 180 degrees apart from each other. After the web has been fully wound up on one of the bobbins, the extended end of the web from the bobbin is cut and then the turret is rotated by 180 degrees to exchange the web wound-up bobbin for an empty bobbin thereby to press the end portion of the web onto the empty bobbin for smoothly winding the web on the bobbin. According to this winding apparatus, since the turret has to be rotated by 180 degrees with the weighty web fully wound up bobbin, the apparatus tends to be formed relatively in a large size. Further, since the weighty web wound up bobbin is supported on the turret, the turret has to be rotated with a lower speed, which may lead to longer bobbin exchange time.

On the other hand, JP3506818B (JP9-063565A) discloses a web winding apparatus which is provided with a rotating disc rotatably provided on a base board and a pair of arm members provided at the both sides of the board and each arm member is projected from the board. A pair of empty bobbins is detachably and rotatably supported on each tip end of the arm members. One of the tip ends of the arm members is set to a web winding position and the other of the tip ends is set to be a winding waiting position. When the bobbin supported on the one of the tip ends of the arm members becomes fully wound state by the web, the rotating disc is rotated by 180 degrees to have the fully wound bobbin to be set to the winding waiting position and the other empty bobbin to be set to the web winding position. Then, the web portion extending from the fully wound bobbin is pressed on the other empty bobbin and is cut. Then the end portion of the web is wound on the empty bobbin. According to this winding apparatus, after exchange of the web fully wound bobbin for an empty bobbin, the extended portion of the web from the fully wound bobbin is pressed onto the empty bobbin to be cut and then the cut end portion thereof is wound on the empty bobbin. This can continuously perform the web winding process, thereby to shorten the time necessary for winding.

DISCLOSURE OF INVENTION

However, according to the web winding apparatuses disclosed in the above JP2807857B (JP7-101604A) and JP3506818B (JP9-063565A), a rotating disc is provided which includes a rotatable turret and arm members for exchanging the web fully wound bobbin for an empty bobbin. These apparatuses become complex in structure and large in overall size.

This invention was made considering the above issues of the related art and it is an object of the invention to provide a web winding apparatus which is small in size and simple in construction.

The web winding apparatus associated with the invention is characterized in that the apparatus comprises two bobbins on which a web is wound, a cutter transferrable between the two bobbins and cutting the web to be transferred and two web pressing members each provided at each side of the cutter and swingable such that when one of the two web pressing members approaches the cutter, the other of the two web pressing members backs away from the cutter, the two web pressing members being transferrable between the two bobbins, wherein the two web pressing members are formed such that upon swinging, the two web pressing members move towards an empty bobbin at the side of the one of the two web pressing members which has been backed away from the cutter and upon swinging, the one of the two web pressing members which has approached the cutter presses an end portion of the web to be cut by the cutter on the empty bobbin thereby to wind the end portion of the web on the empty bobbin.

BRIEF DESCRIPTION OF THE ATTACHED DRAWINGS

Various aspects of this invention will become apparent to those skilled in the art from the following detailed description of the preferred embodiments, when read in light of the accompanying drawings, in which:

FIGS. 8A through 8E show the detail transitional operation states of the web from the third state to the fifth state and wherein FIG. 8A shows the state immediately before the web is cut, FIG. 8B and FIG. 8C show the states that the web is about to be cut, FIG. 8D shows the state that the web is being cut and FIG. 8E shows the state that the cut web is being wound on the empty bobbin;

DETAILED DESCRIPTION OF THE PREFERRED EMBODIMENTS OF THE INVENTION

The preferred embodiments of the web winding apparatus according to the invention will be explained hereinafter with reference to the attached drawings.

First Embodiment:

An Example of Applicable Subject of the Web Winding Apparatus:

The web winding apparatus according to this embodiment is, for example, applied to a device or an apparatus which is used for manufacturing process of lithium battery, wherein the process includes a step for preparing a web roll formed by a thin film web such as aluminum foil being wound around a bobbin, a step for winding off the web roll from the bobbin, step for conducting a coating treatment and step for rewinding the web to be a roll after drying. In more detail, the apparatus is used for winding a web on a bobbin such that upon winding the web on the bobbin to be shaped as a roll, cutting the web fully wound on a bobbin during web transferring operation and winding the end portion of the cut web on another empty bobbin. More particularly, the web winding apparatus according to this embodiment is an apparatus which can wind the end portion of the cut web on an empty bobbin and wind the web on the empty bobbin without providing an exchange device for exchanging a fully wound bobbin for an empty bobbin and yet without stopping the rotational operation of the fully wound bobbin.

Overall Structure of the Web Winding Apparatus:

The overall structure of the web winding apparatus according to this embodiment will be explained with reference to FIG. 1 which shows the front surface side of the apparatus and FIG. 2 which shows the back surface side thereof. It is noted here that the web winding apparatus according to the embodiment shows the apparatus in which the web fully wound on the bobbin is cut during the transferring operation thereof and the cut end portion of the web is wound on another empty bobbin to wind the web on the empty bobbin side. Accordingly, FIG. 1 shows the apparatus having two bobbins, one (right side in FIG. 1) being the fully wound bobbin and the other (left side in FIG. 1) being the empty bobbin.

Figure 1:
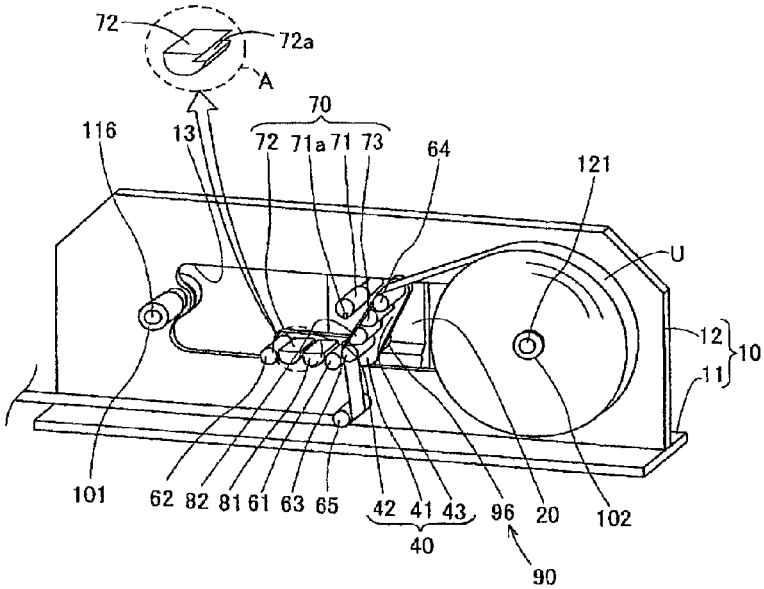
FIG. 1 is a perspective view seen from the front surface side of the web winding apparatus according to an embodiment of the present invention.
Figure 2:
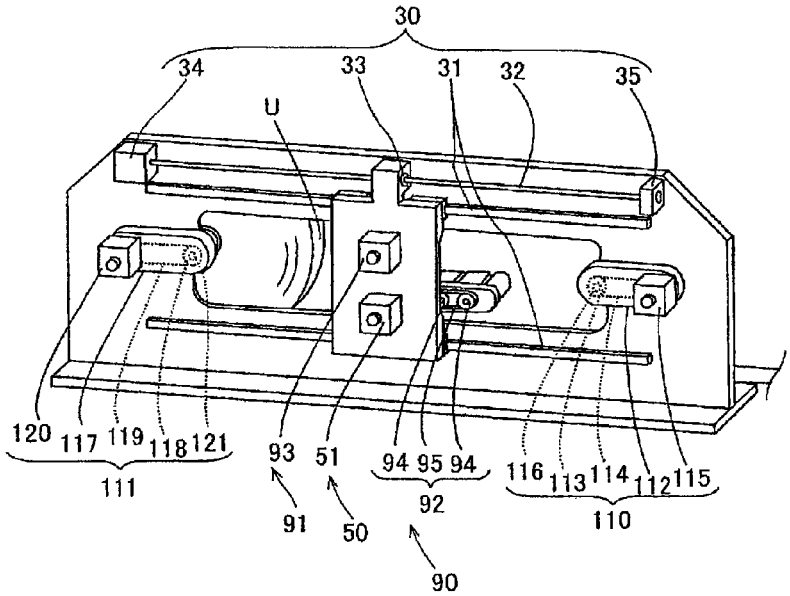
FIG. 2 is a perspective view seen from the back surface side of the web winding apparatus shown in FIG. 1.

As shown in FIGS. 1 and 2, the web winding apparatus is formed by a base board 10, a moving member 20, a movement drive device 30, a swinging member 40, a swing drive device 50, four web supporting members 61 through 64, a transfer roller 65, a cutting device 70, a first web pressing member 81 and a second web pressing member 82, a cutting and winding drive device 90, a first bobbin 101 and a second bobbin 102 and first and second bobbin drive devices 110 and 111. The web winding apparatus is basically formed to have cutting structure for cutting a web U by the cutting device 70 and winding structure for winding the cut web to one of the first and the second bobbins101 and 102 by pressing the web thereon by one of the first and the second web pressing members 81 and 82.

The base board 10 includes a bed 11 provided on a floor and a wall member 12 provided on the bed 11 and projecting from the bed 11. The base board formed by the bed 11 and the wall member 12 is securely fixed to the floor. A rectangular shaped window portion 13 is provided at a center portion of the wall member 12. The two bobbins 101 and 102 are rotatably supported on the front side of the wall member 12 at both sides of the window portion 13 and the transfer roller 65 is also rotatably supported on the lower portion of the wall portion 12 below the central portion of the window portion 13. The moving member 20 is supported on the back side of the wall member 12 and movable along the window portion 13 in a horizontal direction. The two bobbin drive devices 110 and 111 are respectively supported on both sides of the window portion 13 for respectively driving the first and the second bobbins 101 and 102.

The moving member 20 is formed to be approximately in rectangular shape and the length in height direction thereof is longer than the length in a height direction of the window portion 13. The moving member 20 is provided on the back side of the wall member 12 in parallel therewith, crossing over the window portion 13 in the height direction and movable along the window portion 13 in a horizontal direction. The swinging member 40 is swingably supported on the moving member 20 and a cutter 71 of the cutting device 70 is rotatably supported on the moving member 20. Further, the cutting and winding drive device 90 is also supported on the moving member 20.

The movement drive device 30 is formed by a pair of rails 31 and 31, a ball screw 32, a nut 33 engageable with the ball screw 32, a gear motor 34 and a bearing 35. The pair of rails 31 and 31 is provided on the back side of the wall member 12 and at both sides of the window portion 13 in a height direction and is extending in a horizontal direction in parallel with each other. The moving member 20 is provided on the pair of rails 31 and 31 and slidably movably guided thereon in a horizontal direction. The ball screw 32 is provided on the back side of the wall member 12 at the upper portion thereof and is extending in a horizontal direction in parallel with the pair of rails 31 and 31. The ball screw32 is inserted into and engaged with the nut 33. One end of the ball screw 32 is connected to a motor shaft of the gear motor 34 fixed to the back side of the wall member 12 at the upper portion thereof and the other end of the ball screw 32 is rotatably connected to the bearing 35 fixed to the back side of the wall member 12 at the upper portion thereof but opposite side of the gear motor 34 in a horizontal direction.

The movement drive device 30 is a device which moves the moving member 20 between the first bobbin 101 and the second bobbin 102. In more detail, the movement drive device 30 moves the moving member 20 in the first bobbin 101 direction until the second web pressing member 82 which moves together with the moving member 20 approaches and opposes the first bobbin 101 with a small gap formed between an outer peripheral surface of the second web pressing member 82 and an outer peripheral surface of the first bobbin 101. Further, the movement drive device 30 moves the moving member 20 in the second bobbin 102 direction until the first web pressing member 81 which moves together with the moving member 20 approaches and opposes the second bobbin 102 with a small gap formed between an outer peripheral surface of the first web pressing member 81 and an outer peripheral surface of the second bobbin 102.

The swinging member 40 is formed to be with a V-shape. The bottom portion 41 of the V-shape of the swinging member 40 faces downward and is swingably supported on the front surface of the moving member 20, i.e., on the side where the moving member 20 faces the window portion 13. The swinging member 40 swings or rotates centering on the bottom portion 41. Two cutter receiving members 72 and 73 of the cutting device 70, four web supporting members 61 through 64 and two web pressing members 81 and 82 are provided on a first arm portion 42 of the V-shaped swinging member 40 extending from the bottom portion 41 of V-shape of the swinging member 40 towards the first bobbin 101 side and a second arm portion 43 of the V-shape extending from the bottom portion 41 towards the second bobbin 102 side, respectively.

The swing drive device 50 is formed by a gear motor 51 and other associated components. The gear motor 51 is fixed to the back side of the moving member 20 and the motor shaft of the gear motor 51 is inserted into the moving member 20 and is connected to the bottom portion 41 of the swinging member 40.

The swing drive device 50 is a device which drives the swinging member 40 to swing so that the first arm portion 42 and the second arm portion 43 of the swinging member 40 alternately approach the cutter 71 of the cutting device 70 (or alternately separate from the cutter 71). In more detail, the swing drive device 50 is a device which drives the swinging member 40 to swing so that the first cutter receiving member 72 which swings together with the first arm portion 42 of the swinging member 40 approaches the cutter 71 until a circular arc peripheral surface of the first cutter receiving member 72 and the outer peripheral surface of the cutter 71 face each other with a small gap therebetween upon rotation of the first cutter receiving member 72. Further the swing drive device 50 drives the swinging member 40 to swing so that the second cutter receiving member 73 which swings together with the second arm portion 43 of the swinging member 40 approaches the cutter 71 until a circular arc peripheral surface of the second cutter receiving member 73 and the outer peripheral surface of the cutter 71 face each other with a small gap therebetween upon rotation of the second cutter receiving member 73.

The first web supporting member 61 and the second web supporting member 62 are formed to be in cylindrical shape and freely rotatably supported on both ends of the first arm portion 42 respectively. In other words, the first and the second web supporting members 61 and 62 are formed such that the tip end side of the web U which is to be wound on the bobbin 101 is transferred from the transfer roller 65 to the second web supporting member 62 through the first web supporting member 61.

The third web supporting member 63 and the fourth web supporting member 64 are formed to be in cylindrical shape and freely rotatably supported on both ends of the second arm portion 43 respectively. In other words, the third and the fourth web members 63 and 64 are formed such that the tip end side of the web U which is to be wound on the bobbin 102 is transferred from the transfer roller 65 to the third web supporting member 63 through the fourth web supporting member 64.

The transfer roller 65 is supported on the front side of the wall member 12 at a central portion thereof and is positioned below the window portion 13. In other words, the roller 65 supports the web U transferred from the exterior of the apparatus and feeds the web U in from the lower side of the web winding apparatus. According to this embodiment, the web U which has passed through the roller 65 is transferred through the first web supporting member 61 or the third web supporting member 63 both of which are supported by the swinging member 40.

The cutting device 70 includes the cutter 71, the first cutter receiving member 72 and the second cutter receiving member 73. The cutter 71 is formed to be in cylindrical shape and rotatably supported on the moving member 20 between the first and the second arm portions 42 and 43 thereof extending vertically upward from the bottom portion 41 of the V-shaped swinging member 40. A cutter edge or blade 71*a* is provided on the periphery of the cylindrical cutter 71 for cutting the web U. In the state of FIG. 1, since the web is not wound on the first bobbin 101 (empty condition), the cutter 71 is rotated in the same direction to the first bobbin 101 for cutting the web U which is fully wound on the other second bobbin 102. However, when the second bobbin 102 is empty and the first bobbin 101 is fully wound, the winding operation is carried out in reverse.

The first cutter receiving member 72 is formed to be approximately in a cylindrical shape with a portion of the outer periphery being taken away in an axial direction. The first cutter receiving member 72 is provided between the first and the second web supporting members 61 and 62 which are provided on the first arm portion 42 of the swinging member 40 together with the first web pressing member 81 and is rotatably supported on the first arm portion 42. In other words, the first cutter receiving member 72 is provided such that the tip end side of the web U which is to be wound on the first bobbin 101 is transferred to the second web supporting member 62 from the first web supporting member 61 through the first web pressing member 81 and the first cutter receiving member 72.

Figure 14:
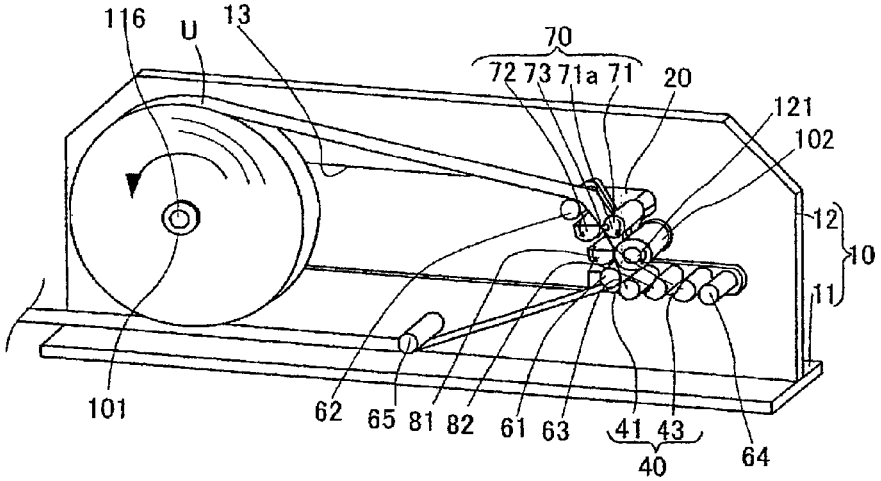
FIG. 14 is a view showing the eleventh state indicating a state immediately before the web is cut.
Figure 15:
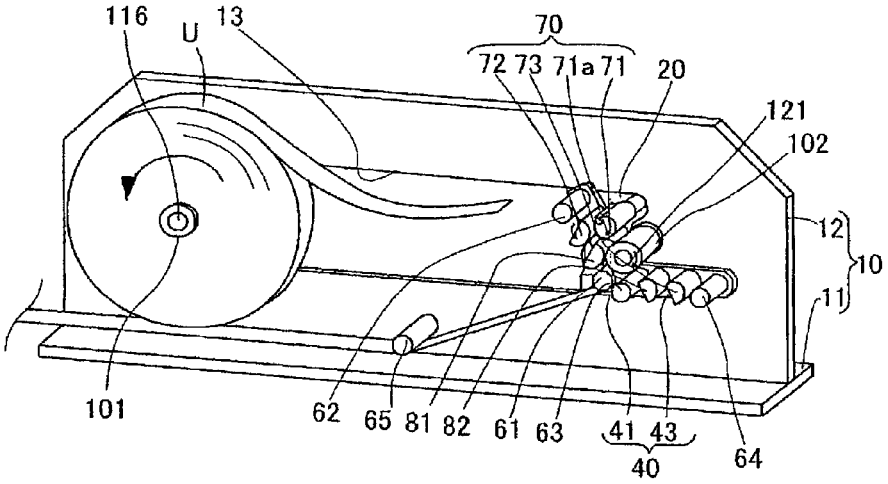
FIG. 15 is a view showing the twelfth state that the web is being cut.

Since the first cutter receiving member 72 faces the cutter 71 with a small gap between the circular arc peripheral surface of the first cutter receiving member 72 and the outer peripheral surface of the cutter 71, the first cutter receiving member 72 serves as a holder when the web U held in the small gap formed between the first cutter receiving member 72 and the cutter 71 is cut by the blade 71*a* of the cutter 71. Accordingly, as shown in the enlarged view "A" indicated in FIG. 1, a groove portion 72*a* is formed on the circular arc peripheral surface of the first cutter receiving member 72 as an escape area for the cutter blade 71*a* of the cutter 71 after cutting operation. This first cutter receiving member 72 is used when the web U which has been fully wound on the first bobbin 101 is cut as shown in FIGS. 14 and 15. It is noted that a suction hole may be provided in the groove portion 72*a* for vacuuming chips of the web U generated upon cutting operation into the hole.

The second cutter receiving member 73 is formed to be approximately in a cylindrical shape having the same diameter with the first cutter receiving member 72, with a portion of the outer periphery being taken away in an axial direction. The second cutter receiving member 73 is provided between the third and the fourth web supporting members 63 and 64 which are provided on the second arm portion 43 of the swinging member 40 together with the second web pressing member 82 and is rotatably supported on the second arm portion 43. In other words, the second cutter receiving member 73 is provided such that the tip end side of the web U which is to be wound on the second bobbin 102 is transferred to the fourth web supporting member 64 from the third web supporting member 63 through the second web pressing member 82 and the second cutter receiving member 73.

Since the second cutter receiving member 73 faces the cutter 71 with a small gap between the circular arc peripheral surface of the second cutter receiving member 73 and the outer peripheral surface of the cutter 71, the second cutter receiving member 73 serves as a holder when the web U held in the small gap formed between the second cutter receiving member 73 and the cutter 71 is cut by the blade 71*a* of the cutter 71. Accordingly, as similar to the structure of the first cutter receiving member 72, a groove portion 73*a* is formed on the circular arc peripheral surface of the second cutter receiving member 73 as an escape area for the cutter blade 71*a* of the cutter 71 after cutting operation. This second cutter receiving member 73 is used when the web U which has been fully wound on the second bobbin 102 is cut. It is noted that a suction hole may be provided in the groove portion 73*a* for vacuuming chips of the web U generated upon cutting operation into the hole as similar to the structure in the groove portion 72*a*.

The first web pressing member 81 is formed to be in approximately half cylindrical shape having a diameter same as the diameter of the first cutter receiving member 72 and a portion of the outer periphery thereof is taken away in an axial direction to form a flat surface thereon. The first web pressing member 81 is provided between the first and the second web supporting members 61 and 62 which are provided on the first arm portion 42 of the swinging member 40 together with the first cutter receiving member 72. The first web pressing member 81 is supported on the first arm portion 42 and rotatable in a direction opposite to the rotation of the first bobbin 101. In other words, the first web pressing member 81 is provided such that the tip end side of the web U which is to be wound on the first bobbin 101 is transferred to the second web supporting member 62 from the first web supporting member 61 through the first web pressing member 81 and the first cutter receiving member 72. Since the first web pressing member 81 faces with the second bobbin 102 with a small gap between the outer peripheral surface of the first web pressing member 81 and the outer peripheral surface of the second bobbin 102, the end portion of the web U is held in the small gap between the first web pressing member 81 and the second bobbin 102 is pressed onto the second bobbin 102 so that the end portion of the web U is adhered to a double face adhesive tape 102*a* (refer to FIG. 10) provided on the outer peripheral surface of the second bobbin 102.

The second web pressing member 82 is formed to be in approximately half cylindrical shape having a diameter same as the diameter of the second cutter receiving member 73 and a portion of the outer periphery thereof is taken away in an axial direction to form a flat surface thereon. The second web pressing member 82 is provided between the third and the fourth web supporting members 63 and 64 which are provided on the second arm portion 43 of the swinging member 40 together with the second cutter receiving member 73. The second web pressing member 82 is supported on the second arm portion 43 and rotatable in a direction opposite to the rotation of the second bobbin 102. In other words, the second web pressing member 82 is provided such that the tip end portion of the web U which is to be wound on the second bobbin 102 is transferred to the fourth web supporting member 64 from the third web supporting member 63 through the second web pressing member 82 and the second cutter receiving member 73. Since the second web pressing member 82 faces with the first bobbin 101 with a small gap between the outer peripheral surface of the second web pressing member 82 and the outer peripheral surface of the first bobbin 101, the end portion of the web U is held in the small gap and is pressed onto the first bobbin 101 so that the end portion of the web U is adhered to a double face adhesive tape 101*a* (refer to FIG. 3) provided on the outer peripheral surface of the first bobbin 101.

The cutting and winding drive device 90 is formed by a cutter drive device 91 for driving the cutter 71 and a web receiving and pressing drive device 92 for driving the first and the second cutter receiving members and the first and the second web pressing members 81 and 82. The cutter drive device 91 includes a gear motor 93. The gear motor 93 is fixed to the back surface of the moving member 20 and a motor shaft of the gear motor 93 is inserted into the moving member 20 and connected to the rotation shaft of the cutter 71.

The web receiving and pressing drive device 92 is formed by pulleys 94, belt 95 and a gear motor 96. The pulleys 94 are inserted into the respective rotation shafts of the first and the second cutter receiving members 72 and 73 and the first and the second web pressing members 81 and 82, each member being projecting towards the back side of the swinging member 40 and the motor shaft of the gear motor 96. The belt 95 is wound around over all pulleys 94. The gear motor 96, a portion of which is shown in FIG. 1, is fixed to the back side of the swinging member 40 between the swinging member 40 and the moving member 20 and the motor shaft of the gear motor 96 is inserted into the swinging member 40.

The cutter drive device 91 is structured to rotate the cutter 71 in the same direction (in a clockwise direction as viewed in FIG. 1) with the rotation direction of the first bobbin 101 synchronizing with the first bobbin 101 when the web U is wound on the first bobbin 101 and to rotate the cutter 71 in the same direction (in a counterclockwise direction as viewed in FIG. 1) with the rotation direction of the second bobbin 102 synchronizing with the second bobbin 102 when the web U is wound on the second bobbin 102. In detail, the moving speed of the outer peripheral surface of the cutter 71 is set to be equal to the moving speed of the outer peripheral surface of the first bobbin 101 or the second bobbin 102.

The web receiving and pressing drive device 92 is structured to rotate the first and the second cutter receiving members 72 and 73 and the first and the second web pressing members 81 and 82 in the opposite direction (in a clockwise direction as viewed in FIG. 1) with the rotation direction of the first bobbin 101 synchronizing with the first bobbin 101 when the web U is wound on the first bobbin 101 and to rotate the first and the second cutter receiving members 72 and 73 and the first and the second web pressing members 81 and 82 in the opposite direction (in a clockwise direction as viewed in FIG. 1) with the rotation direction of the second bobbin 102 synchronizing with the second bobbin 102 when the web U is wound on the second bobbin 102. In detail, the moving speeds of the outer peripheral surfaces of the first and the second cutter receiving members 72 and 73 are set to be equal to the moving speed of the outer peripheral surface of the cutter 71 or the moving speeds of the outer peripheral surfaces of the first and the second web pressing members 81 and 82 are set to be equal to the moving speed of the outer peripheral surface of the first bobbin 101.

The first and the second bobbins 101 and 102 are supported on the front side of the wall member 12 of the base board 10 at both sides of the window portion 13 and are rotatable about the respective center axes in opposite directions. The first and the second bobbins 101 and 102 are detachably inserted into respective bobbin carrying shafts 116 and 121. As shown in FIG. 1, when the second bobbin 102 is fully wound by the web U, the other first bobbin 101 is used for winding the web U thereon. On the contrary, when the first bobbin 101 is fully wound by the web U, the second bobbin 102 is used for winding the web U thereon. The empty state bobbins 101 and 102 are provided with the double face adhesive agents 101*a* and 102*a* (See FIG. 3 and FIG. 10).

A first bobbin drive device 110 is formed by a cover 112, pulleys 113, belt 114, gear motor 115 and the bobbin carrying shaft 116. The cover 112 is fixed to the back side of the wall member 12 of the base board 10 at the outside (right side as viewed in FIG. 2) of the window portion 13 and covers the pulleys 113 and the belt 114. The pulleys 113 are inserted into the bobbin carrying shaft 116 and the motor shaft of the gear motor 115 which are projecting towards the back side of the wall portion 12 of the base board 10. The belt 114 is wound on the two pulleys 113 and bridging over therebetween. The gear motor 115 is fixed to the back side of the cover 112 and the motor shaft of the gear motor 115 is inserted into the cover 112. The bobbin carrying shaft 116 is rotatably inserted into the wall member 12 of the base board 10 through a bearing (not shown). The first bobbin 101 is supported on the bobbin carrying shaft 116 at the front side of the wall member 12.

The second bobbin drive device 111 is formed by a cover 117, pulleys 118, a belt 119, a gear motor 120 and bobbin carrying shaft 121. The cover 117 is fixed to the back side of the wall member 12 of the base board 10 at the outside (left side as viewed in FIG. 2) of the window portion 13 and covers the pulleys 118 and the belt 119. The pulleys 118 are inserted into the bobbin carrying shaft 121 and the motor shaft of the gear motor 120 which are projecting towards the back side of the wall portion 12 of the base board 10. The belt 119 is wound on the two pulleys 118 and bridging over therebetween. The gear motor 120 is fixed to the back side of the cover 117 and the motor shaft of the gear motor 120 is inserted into the cover 117. The bobbin carrying shaft 121 is rotatably inserted into the wall member 12 of the base board 10 through a bearing (not shown). The second bobbin 102 is supported on the bobbin carrying shaft 121 at the front side of the wall member 12.

(Web Winding Operation of the Web Winding Apparatus)

Figure 3:
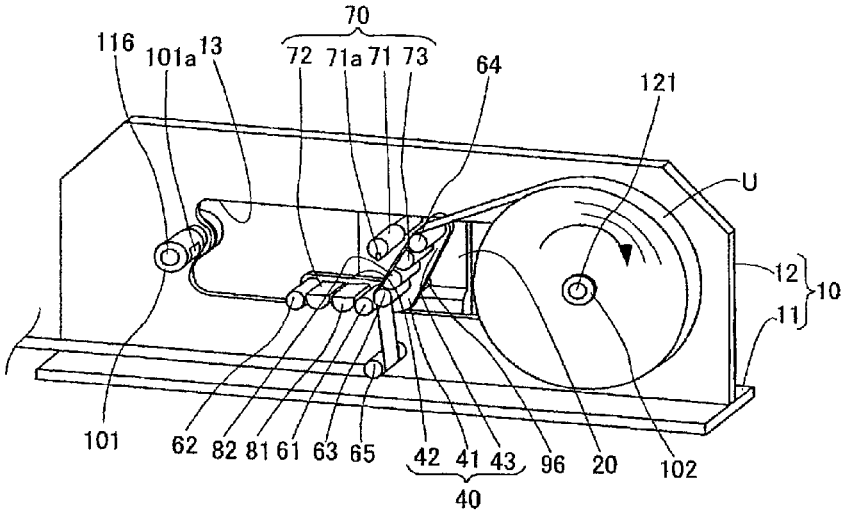
FIG. 3 is a view showing the first state (initial state) that the moving member is set to the position between the empty bobbin and the fully wound bobbin.

The operation of cutting the web fully wound on the bobbin and winding the cut web on the empty side bobbin will be explained with reference to FIGS. 3 through 19. FIGS. 3 through 19 (except FIGS. 8A through 8E) show the various states following the time course of operation). First, the state shown in FIG. 3 is assumed to be the initial state (first state). The initial state is the state that the second bobbin 102 is being rotated in the clockwise direction thereby to wind-up the web U on the second bobbin. The second bobbin 102 is in the state where the web U is fully wound on the bobbin. Under this state, the moving member 20 is set to be positioned at the middle of the first and the second bobbins 101 and 102, the second arm portion 43 of the swinging member 40 is set to be in approached position to the cutter 71 (the first arm portion 42 at this state being set to be in separated position from the cutter 71) and the cutter 71 is stopped with the blade 71*a* facing downward. The second cutter receiving member and the second web pressing member 82 are stopped with the flat surfaces thereof being inclined with an inclined angle of approximately the same with the inclined angle of the second arm portion 43. The cutter 71 and the second cutter receiving member 73 are separated from each other and the flat surfaces of the second web pressing member 82 and the second cutter receiving member 73 are positioned on the same plane. The web U which is transferred from outside through the transfer roller 65 is being wound on the second bobbin 102 from the third web supporting member 63 via the second web pressing member 82, the second cutter receiving member 73 and the fourth web supporting member 64.

Figure 4:
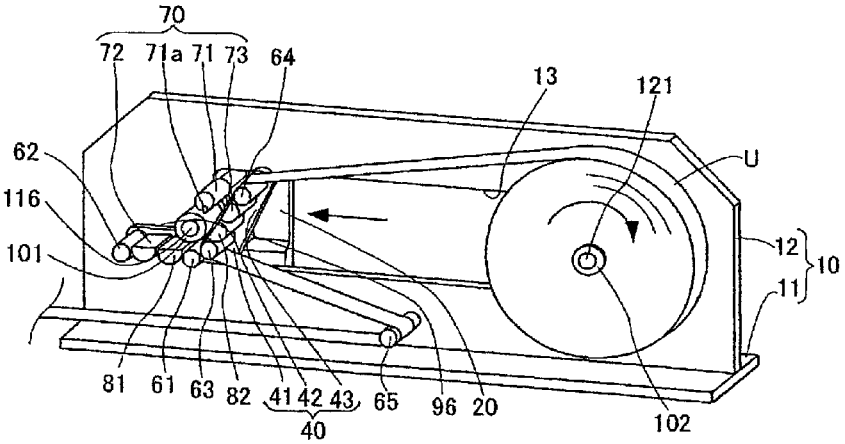
FIG. 4 is a view showing the second state that the moving member has been moved to the empty bobbin.

The first state is set to be the reference position and as shown in FIG. 4, under second state, the swinging member 40, the cutter 71, the second cutter receiving member 73 and the second web pressing member 82 are kept unchanged, but the moving member 20 moves towards the empty bobbin 101 side to set the position of the second web pressing member 82 by approaching the second web pressing member 82 towards the first bobbin 101 side. In this state, the web U which is transferred from outside through the transfer roller 65 is continuously being wound on the second bobbin 102 from the third web supporting member 63 via the second web pressing member 82, the second cutter receiving member 73 and the fourth web supporting member 64.

Figure 5:
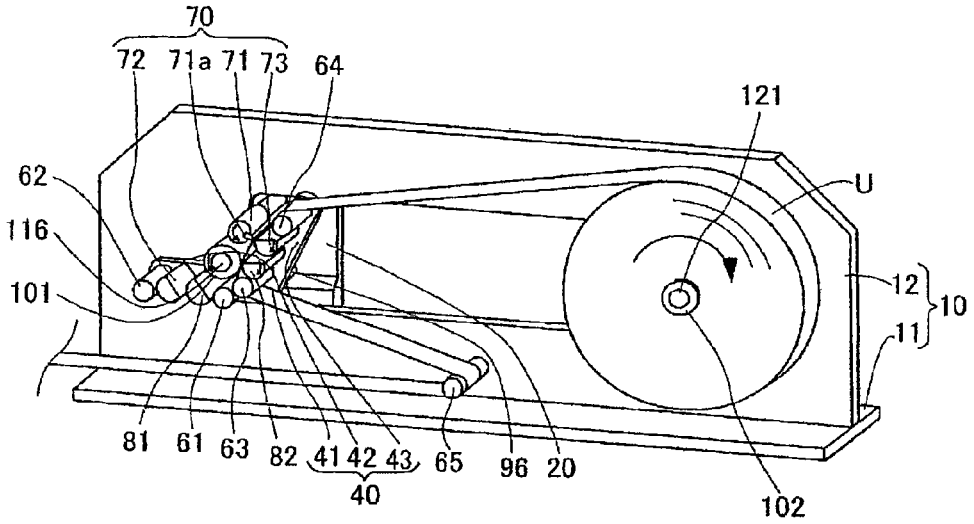
FIG. 5 is a view showing the third state indicating a state immediately before the web is cut.
Figure 6:
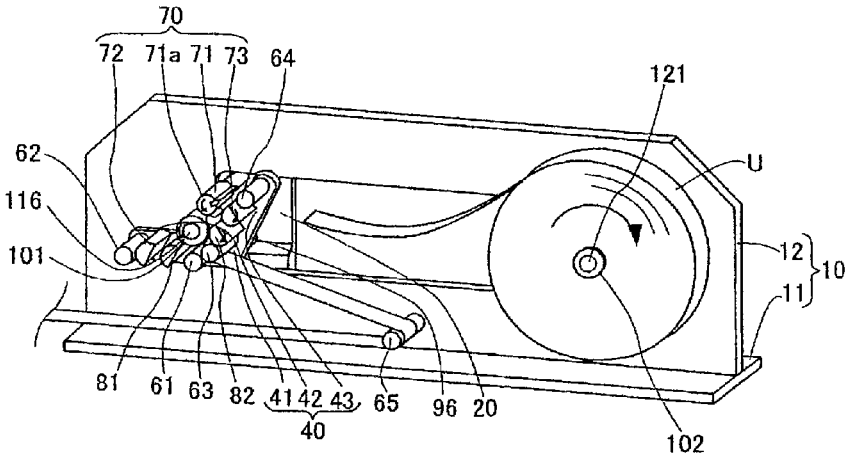
FIG. 6 is a view showing the fourth state that the web is being cut.
Figure 7:
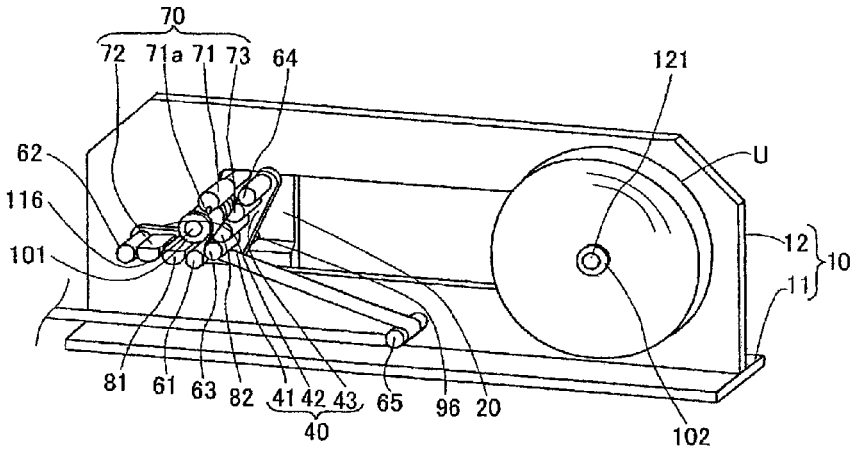
FIG. 7 is a view showing the fifth state that the web has been wound on the empty bobbin.

Then as shown in FIGS. 5, 6 and 7, which show the third, fourth and fifth state, respectively, the cutter 71 and the first bobbin 101 are rotated in the counterclockwise direction with the speed same as the transfer speed of the web U for synchronized rotation therewith. At the same time, the second cutter receiving member 73 and the second web pressing member 82 are rotated in the clockwise direction with the speed same as the transfer speed of the web U for synchronized rotation therewith to perform web cutting operation and web winding operation. In the cutting device 70, the cutter blade 71*a* of the cutter 71 and the groove portion 73*a* of the cutter receiving member 73 are operated to closely approach each other and cut the web U being transferred by pressingly holding the web U between the cutter blade 71*a* and the groove portion 73*a* and at the same time, the outer peripheral surface of the second web pressing member 82 and the outer peripheral surface of the first bobbin 101 are operated to closely approach each other and the cut end portion of the web U is pressed by the outer peripheral surface of the second web pressing member 82 on the outer peripheral surface of the first bobbin 101 to wind the end portion on the first bobbin 101. The wound end portion of the web U is then adhered to the double face adhesive tape 101*a* and then the web U is wound on the first bobbin 101 in accordance with the rotation of the bobbin 101. If the speed of the rotation of the first bobbin 101 is constant, the transfer speed of the web U becomes higher as the winding diameter of the web becomes large. Therefore, the transfer speed of the web U is kept constant by lowering the rotation speed of the first bobbin 101 as the winding diameter of the web U becomes large.

The detail operation of web cutting and winding will be explained hereinafter with reference to FIGS. 8A through 8E. During operation shown in FIG. 8A from operation shown in FIG. 8B, the cutter 71 and the first bobbin 101 initiate synchronized rotation in the counterclockwise direction and the rotation speed is accelerated to agree to the transfer speed of the web U. After the both speeds agreed, the synchronized rotation speed of the cutter 71 and the first bobbin 101 and the transfer speed of the web U are controlled to be the same speed. At the same time, the second cutter receiving member 73 and the second web pressing member 82 initiate synchronized rotation in the clockwise direction and the synchronized rotation speed is accelerated to agree to the transfer speed of the web U. After the both speeds agreed, the synchronized rotation speed of the second cutter receiving member 73 and the second web pressing member 82 and the transfer speed of the web U are controlled to be the same speed. Then the portion of the web U indicated by the symbol "Ua" in FIG. 8B starts to be squeezed between the cutter blade 71*a* and the groove portion 73*a* and the portion indicated by the symbol "Ub" in FIG. 8B starts to be squeezed between the outer peripheral surfaces of the second web pressing member 82 and the first bobbin 101.

Figure 8A:
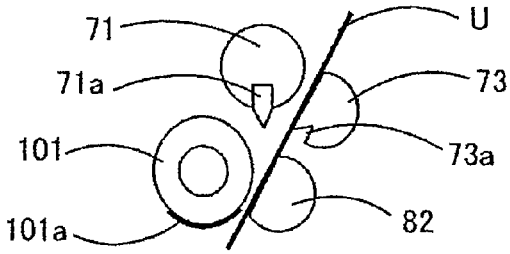

Under the state shown in FIG. 8A, sufficient gaps are shown between the outer peripheral surfaces of the cutter 71 and the first bobbin 101 and between the outer peripheral surfaces of the second web pressing member 82 and the first bobbin 101. Accordingly, at this stage the web U being transferred is not held or squeezed between the outer peripheral surfaces of the cutter 71 and the first bobbin 101 and between the outer peripheral surfaces of the second web pressing member 82 and the first bobbin 101.

Figure 8B:
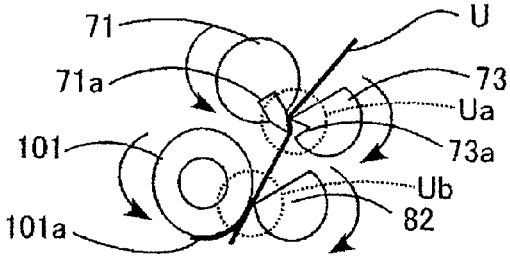

Under the state shown in FIG. 8B, the synchronized speeds of the cutter 71 and the first bobbin 101 and the second web pressing member 82 and the first bobbin 101 are under acceleration and accordingly, the transfer speed of the web U held between the outer peripheral surface of the cutter 71 and the outer peripheral surface of the first bobbin 101 and the transfer speed of the web U held between the outer peripheral surface of the second web pressing member 82 and the outer peripheral surface of the first bobbin 101 are consecutively changing. Therefore, the rotation speeds of the gear motors 93 and 96 of the cutting and winding drive device 90 are controlled to accord the rotation speeds of the outer peripheral surfaces of the cutter 71 and the first bobbin 101 and the outer peripheral surfaces of the second web pressing member 82 and the first bobbin 101 to the transfer speed of the web U. It is noted that the third and the fourth web supporting members 63 and 64 are properly supporting the web U.

Figure 8C:
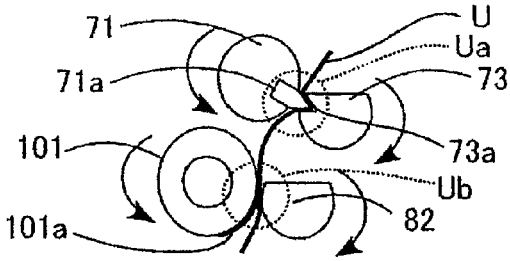
Figure 8D:
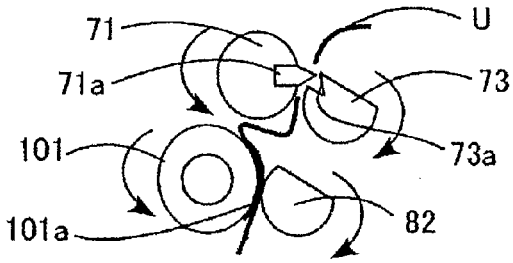

Then as shown in FIGS. 8C and 8D, the cutter 71 and the first bobbin 101 make further synchronizing rotation in the counterclockwise direction and at the same time the second cutter receiving member 73 and the second web pressing member 82 make synchronizing rotation in the clockwise direction. Then the web U at the portion Ua is squeezed between the cutter blade 71*a* and the groove 73*a* of the second cutter receiving member 73 and cut therebetween. The downstream side of the web U from the portion Ub is held between the outer peripheral surfaces of the second web pressing member 82 and the first bobbin 101 and is wound on the outer peripheral surface of the first bobbin 101 to be adhered to the double face adhesive tape 101*a* provided on the outer peripheral surface of the bobbin 101. Accordingly, the end portion of the web U can be wound on the outer peripheral surface of the first bobbin 101 without stopping the rotation of the first bobbin 101.

Figure 8E:
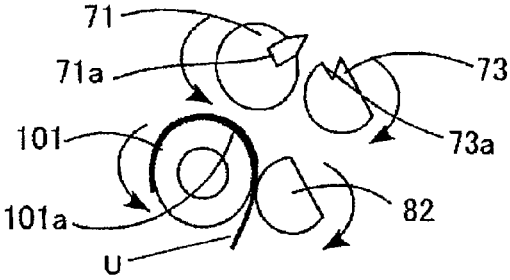

As shown in FIG. 8E, the cutter 71 and the first bobbin 101 make further synchronizing rotation in the counterclockwise direction and at the same time, the second cutter receiving member 73 and the second web pressing member 82 make further synchronizing rotation in the clockwise direction. The web portion between the portions Ua and Ub are wound on the outer peripheral surface of the first bobbin 101. Then the rotations of the cutter 71, the second cutter receiving member 73 and the second web pressing member 82 are stopped and only the rotation of the first bobbin 101 is continued to be rotated to wind the web U thereon.

Figure 9:
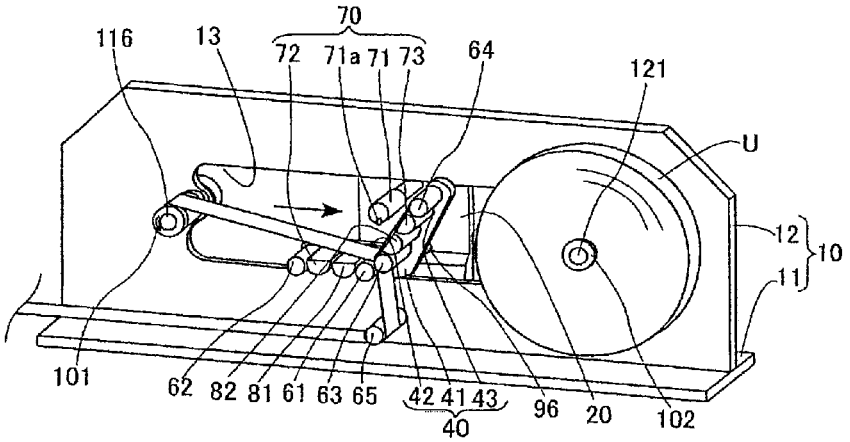
FIG. 9 is a view showing the sixth state that the moving member has moved to an intermediate position between the empty bobbin and the fully wound bobbin.

Next, as shown in FIG. 9 which shows the sixth state, the moving member 20 is moved towards the second bobbin 102 side which is fully wound by the web U and is positioned at the intermediate portion between the first and the second bobbins 101 and 102, keeping the swinging member 40, cutter 71, the second cutter receiving member 73 and the second web pressing member 82 unchanged. Under this sixth state, the cut web U at the first bobbin 101 side is transferred and wound on the bobbin 101 with tension given by the first bobbin 101.

Figure 10:
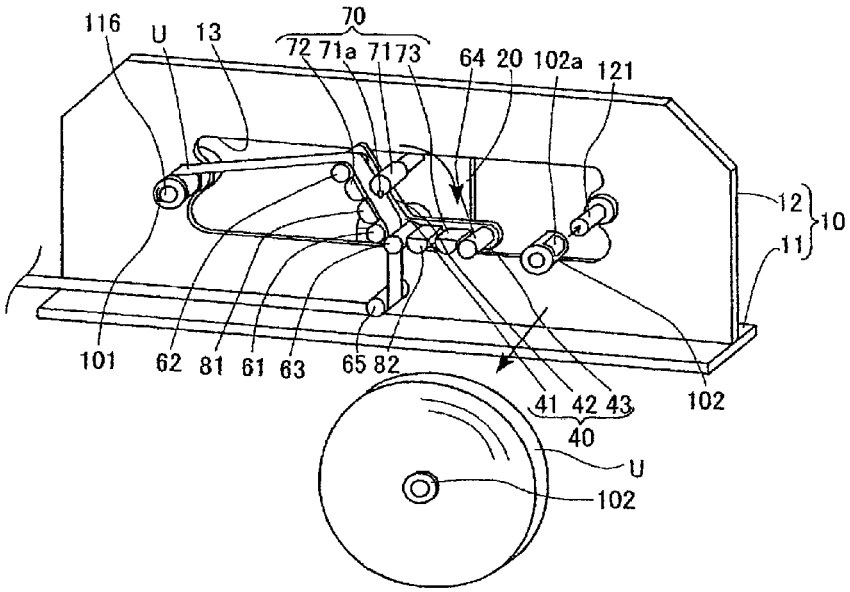
FIG. 10 is a view showing the seventh state that the swinging member is being swung.
Figure 11:
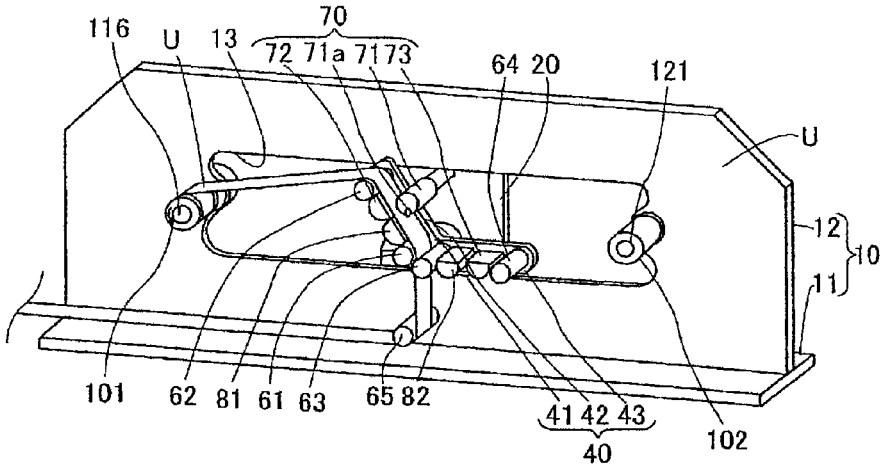
FIG. 11 is a view showing the eighth state that the fully wound bobbin has been removed.

FIG. 10 shows the seventh state and under this state, the swinging member 40 swings to set the position thereof so that the first arm portion 42 of the swinging member 40 approaches the cutter 71 (the second arm portion 43 separates from the cutter 71). Under this state, the cutter stops with the blade 71*a* facing downward. The first cutter receiving member 72 and the first web pressing member 81 are stopped with the flat surfaces thereof being inclined with an inclined angle of approximately the same with the inclined angle of the first arm portion 42. The cutter 71 and the first cutter receiving member 72 are separated from each other and the flat surfaces of the first web pressing member 81 and the first cutter receiving member 72 are positioned on the same plane. The web U which is transferred from outside through the transfer roller 65 is being wound on the first bobbin 101 from the first web supporting member 61 via the first web pressing member 81, the first cutter receiving member 72 and the second web supporting member 62. As shown in FIGS. 10 and 11 which show the seventh and the eighth states respectively, the second bobbin 102 on which the web U has been fully wound is detached from the bobbin carrying shaft 121 and a new empty second bobbin 102 with the double face adhesive tape thereon is inserted into the bobbin carrying shaft 121.

Figure 12:
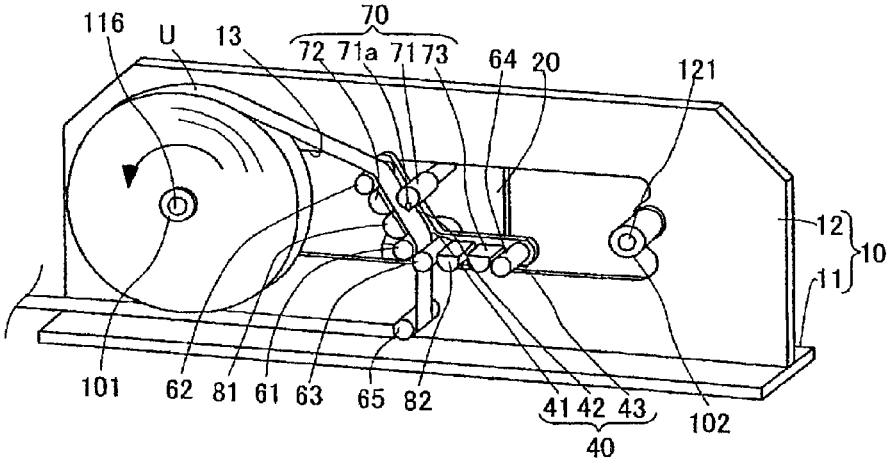
FIG. 12 is a view showing the ninth state that the empty bobbin has been fully wound to become a fully wound bobbin.
Figure 13:
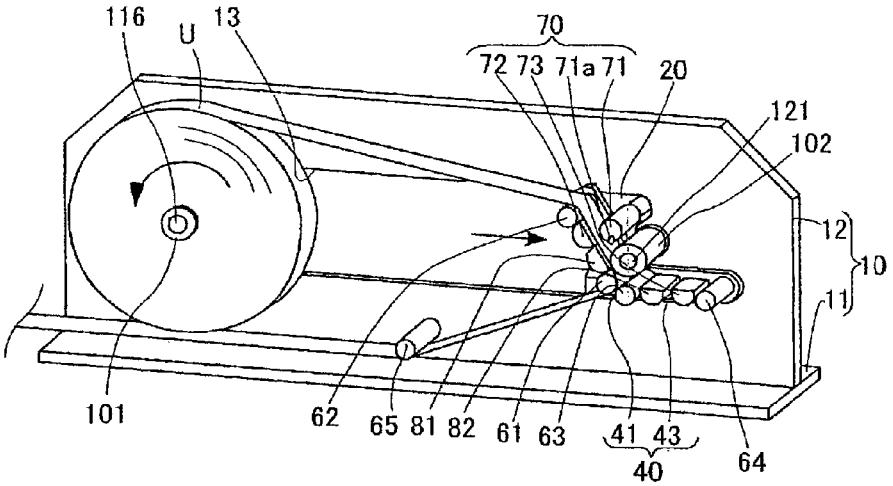
FIG. 13 is a view showing the tenth state that the moving member has been moved to the empty bobbin side.

As shown in FIG. 12 which shows the ninth state, after the first bobbin is fully wound by the web U, the moving member 20 moves towards the empty second bobbin 102 side keeping the swinging member 40, the cutter 71, the first cutter receiving member 72 and the first web pressing member 81 unchanged thereby to set the position by approaching the first web pressing member 81 to the second bobbin 102 as shown in FIG. 13 which shows the tenth state. The web U which has been transferred from outside through the transfer roller 65 is wound on the first bobbin 101 from the first web supporting member 61 via the first web pressing member 81, first cutter receiving member 72 and the second web supporting member 62.

Figure 16:
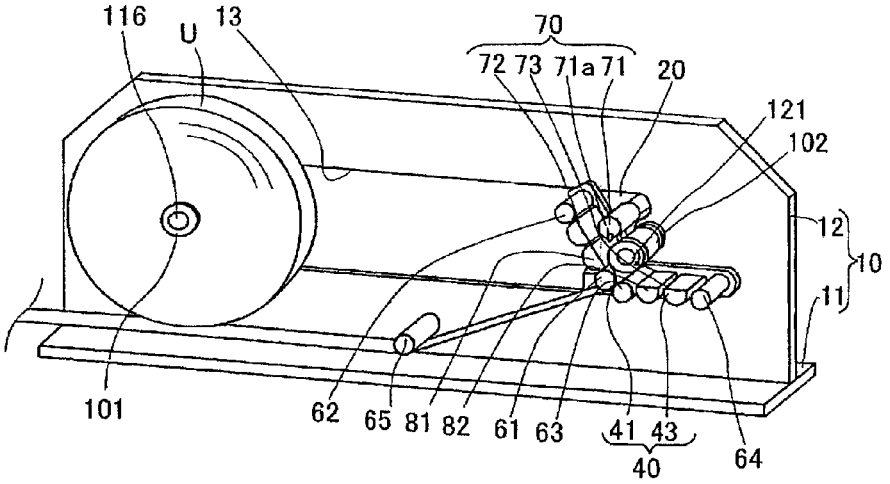
FIG. 16 is a view showing the thirteenth state that the web has been wound on the empty bobbin.

As shown in FIGS. 14, 15 and 16 which show the eleventh, twelfth and thirteenth respectively, the cutter 71 and the second bobbin 102 make a synchronized rotation in the counterclockwise direction to accord the rotation speed to the transfer speed of the web U and at the same time, the first cutter receiving member 72 and the first web pressing member 81 make a synchronized rotation in the clockwise direction to accord the rotation speed to the transfer speed of the web U thereby to perform cutting and winding operations.

Figure 17:
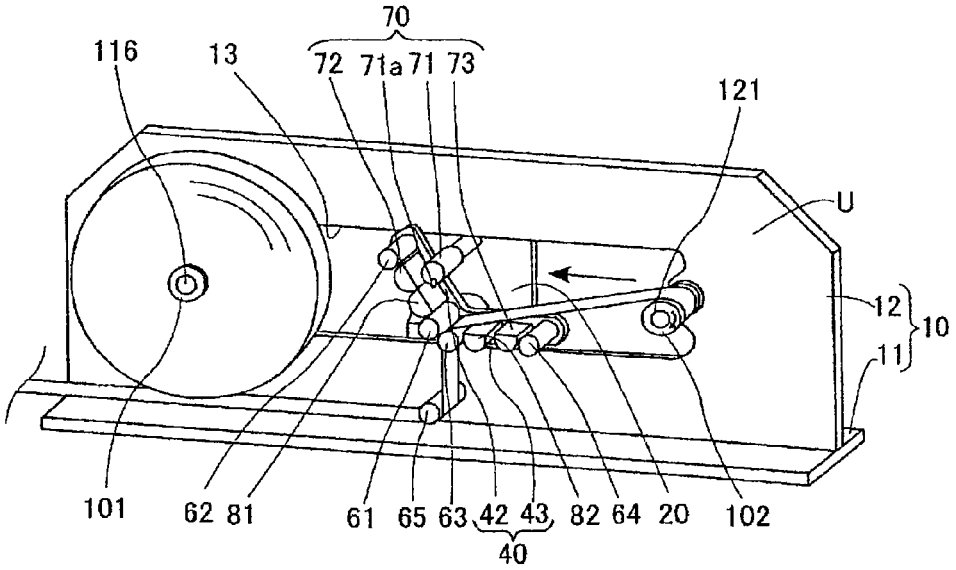
FIG. 17 is a view showing the fourteenth state that the moving member has moved to an intermediate position between the empty bobbin and the fully wound bobbin.

Next, as shown in FIG. 17 which shows the fourteenth state, the moving member 20 is moved towards the first bobbin 101 side which is fully wound by the web U and is positioned at the intermediate portion between the first and the second bobbins 101 and 102, keeping the swinging member 40, cutter 71, the first cutter receiving member 72 and the first web pressing member 81 unchanged. Under this fourteenth state, the cut web U at the second bobbin 102 side is transferred and wound on the bobbin 102 with tension given by the second bobbin 102.

Figure 18:
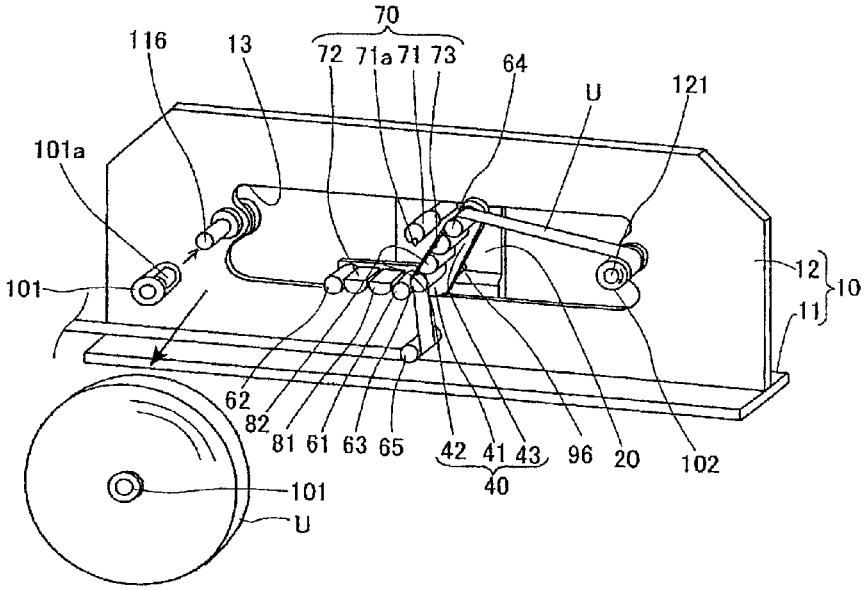
FIG. 18 is a view showing the fifteenth state that the swinging member is being swung.
Figure 19:
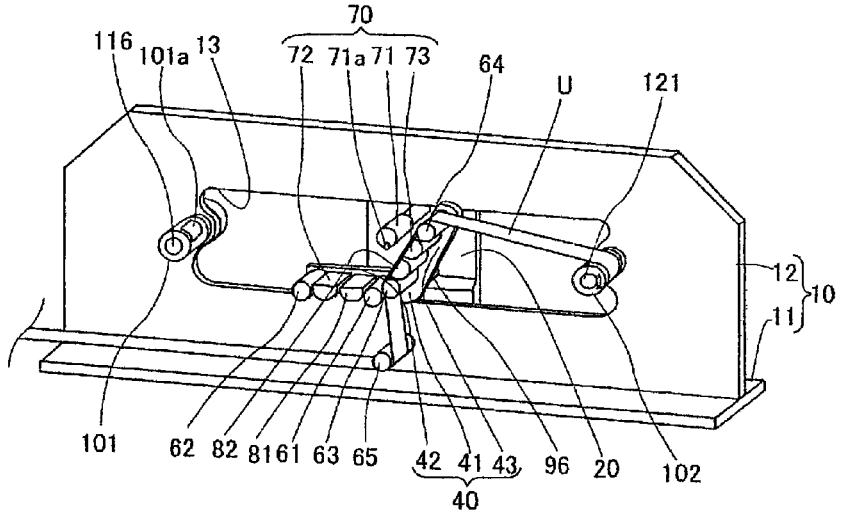
FIG. 19 is a view showing the sixteenth state that the fully wound bobbin has been removed.

Further, as shown in FIG. 18 which shows the fifteenth state, the swinging member 40 swings to set the position thereof so that the second arm portion 43 of the swinging member 40 approaches the cutter 71 (the first arm portion 42 separates from the cutter 71). Under this state, the cutter 71 stops with the blade 71*a* facing downward. The second cutter receiving member 73 and the second web pressing member 82 are stopped with the flat surfaces thereof being inclined with an inclined angle of approximately the same with the inclined angle of the second arm portion 43. The cutter 71 and the second cutter receiving member 73 are separated from each other and the flat surfaces of the second web pressing member 82 and the second cutter receiving member 73 are positioned on the same plane. The web U which is transferred from outside through the transfer roller 65 is being wound on the second bobbin 102 from the third web supporting member 63 via the second web pressing member 82, the second cutter receiving member 73 and the fourth web pressing member 64. As shown in FIGS. 18 and 19 which show the fifteenth and the sixteenth states respectively, the first bobbin 101 on which the web U has been fully wound is detached from the bobbin carrying shaft 116 and a new empty first bobbin 101 with the double face adhesive tape thereon is inserted into the bobbin carrying shaft 116. The operation showing the first to sixteenth states is repeated.

As explained above, the cutter 71 and one of the first and the second web pressing members 81 and 82 approach one of the empty first and the second bobbins 101 and 102 to cut the web U to be transferred and to wind the web on the empty bobbin. This structure can eliminate a conventional large sized and complicated bobbin exchange device and can provide a small sized and simply structured web winding apparatus.

Further, since either one of the first or the second web pressing member 81 or 82, either one of the second or the first bobbin 102 or 101 and the cutter 71 makes a synchronized rotation to cut the web U which is being transferred and to wind the cut web on the empty bobbin side, the web U can be accurately transferred to prevent any cutting defect or winding failure caused by defective transfer operation. Further, either one of the first or the second web pressing member 81 or 82 is formed to wind the end portion of the web U which has been fully wound on either one of the second or the first bobbin 102 and 101 on the other empty bobbin. Thus, the fully wound bobbin can be removed and empty bobbin can be replaced therefor and these two operations can be alternately made to improve efficiency of web U winding operation.

Further, the cutter 71 and either one of the first cutter receiving member 72 or the second cutter receiving member 73 are formed to cut the web U by sandwiching therebetween. This can improve the accuracy of cutting operation and successfully wind the web U on either one of the second bobbin 102 or the first bobbin 101. Still further, the web supporting members 61 through 64 are formed to support the web U which is being transferred. This can transfer the web U giving proper tension thereon thereby preventing the web U from entrapment into or undesired entanglement with the first or the second cutter receiving member 72 or 73 under rotation and the cutter 71.

By swinging the swinging member 40 centering on the bottom portion 41 of V-shape, when the first web pressing member 81 or the second web pressing member 82 moves to the empty bobbin side, one of the web pressing members which has been away from the cutter 71 can be escaped outside from the empty bobbin without interfering therewith. Thus the other web pressing member which has approached to the cutter 71 by swinging of the swinging member 40 can surely press and wind the end portion of the web U which is to be cut by the cutter 71 on the empty bobbin.

According to a first aspect of the embodiment of the invention, the web winding apparatus includes two bobbins 101, 102 on which a web U is to be wound, a cutter 71 transferrable between the two bobbins and cutting the web to be transferred and two web pressing members 81 and 82 positioned at opposite sides of the cutter and swingable such that when one of the two web pressing members approaches the cutter, the other of the two web pressing members backs away from the cutter, the two web pressing members being transferrable together with the cutter between the two bobbins, wherein the two web pressing members 81 and 82 are formed such that upon swinging, the two web pressing members move towards an empty one of the two bobbins positioned at one of the two web pressing members side which has been backed away from the cutter and upon swinging, the other of the two web pressing members which has approached the cutter presses an end portion of the web on the empty bobbin which has been cut by the cutter thereby to wind the end portion of the web on the empty bobbin According to the first aspect of the embodiment of the invention, a complex and large sized bobbin exchange device can be eliminated and the web winding apparatus which is small in size and simple in structure can be proposed.

According to another aspect (second aspect) of the embodiment of the invention, the web winding apparatus is characterized in that the two bobbins 101 and 102 are rotatably supported on respective central axes 116 and 121 thereof and rotatable in opposite directions to each other, the cutter 70 is rotatable in the same direction with respective rotation directions of the two bobbins, the two web pressing members 81 and 82 are rotatable in the opposite directions to the rotation directions of the respective empty bobbins 102 or 101 on which the end portion of the web U has been pressed. The apparatus is further characterized in that by rotating one of the web pressing members 81 or 82 synchronizing with the rotations of the corresponding one of the empty bobbins 102 or 101 and the cutter 70 at a predetermined position where the one web pressing member 81 has approached the one empty bobbin 102, the end portion of the web which is to be cut by the cutter is wound on the one empty bobbin.

This structure of the embodiment can achieve a highly precise transfer operation and at the same time prevent the web from cutting failure or winding failure caused by inaccurate web transfer operation.

According to further aspect (third aspect) of the embodiment, the web pressing members 81 and 82 are formed so that the end portion Ua or Ub of the web U which has been fully wound on the other 101 of the two bobbins 101 or 102 is wound on the one bobbin 102 which is empty.

According to this structure, the removing of the fully wound bobbin and attaching of the empty bobbin can be alternately performed, which can, in turn, improve web winding efficiency.

According to further aspect (fourth aspect) of the embodiment of the invention, two cutter receiving members 72 and 73 are provided at respective sides in web transfer directions of the two web pressing members 81 and 82 and swingable with the two web pressing members 81 and 82 for cutting the web with the cutter by sandwiching the web giving a pressure together therewith.

This structure can enable the web U to be accurately cut, thereby to wind the web on the bobbin successfully.

According to still another aspect (fifth aspect) of the embodiment of the invention, the web supporting members 61 through 64 for supporting the web to be transferred are rotatably provided at respective sides of two pairs of the web pressing members 81, 82 and the cutter receiving members 72, 73 and swingable with the two pairs of the web pressing members 81, 82 and the cutter receiving members 72, 73.

Since the web supporting members 61 through 64 support the web U to be transferred so that the web can be smoothly transferred without being loosened by applying an appropriate tension on the web, this can prevent the web from entrapment into the web pressing members 81, 82 or the cutter 70.

Further, according to further aspect (sixth aspect) of the embodiment, the two pairs of the web pressing members 81 and 82, the cutter receiving members 72 and 73 and the web supporting members 61 through 64 are arranged to form a V-shape.

In this sixth aspect of the structure of the embodiment, the bent portion 41 (bottom of V-shape) V-shaped swinging members 40 is set to be the swinging center and when the web pressing members 81, 82 are moved to the empty bobbin, the web pressing member 81 which has been backed away from the cutter 71 upon swinging can escape from the empty bobbin outside thereof without interfering with the empty bobbin.

Thus, the web pressing member 82 which has been approached towards the cutter 71 upon swinging can surely press the end portion of the web to be cut by the cutter on the empty bobbin and wind the web thereon.

The invention claimed is:

1. A web winding apparatus comprising:

two bobbins on which a web is to be wound;

a cutter transferrable between the two bobbins and cutting the web to be transferred; and two web pressing members positioned at opposite sides of the cutter and swingable such that when one of the two web pressing members approaches the cutter, the other of the two web pressing members backs away from the cutter, the two web pressing members being transferrable together with the cutter between the two bobbins, wherein the two web pressing members are formed such that upon swinging, the two web pressing members move towards an empty one of the two bobbins positioned at one of the two web pressing members side which has been backed away from the cutter and upon swinging, the other of the two web pressing members which has approached the cutter presses an end portion of the web on the empty bobbin which has been cut by the cutter thereby to wind the end portion of the web on the empty bobbin, wherein the two bobbins are rotatably supported on respective central axes thereof and rotatable in opposite directions to each other, the cutter is rotatable in the same direction with respective rotation directions of the two bobbins, the two web pressing members are rotatable in the opposite directions to the rotation directions of the respective empty bobbins on which the end portion of the web has been pressed, and wherein by rotating one of the web pressing members synchronizing with the rotations of the corresponding one of the empty bobbins and the cutter at a predetermined position where the one web pressing member has approached the one empty bobbin, the end portion of the web which is to be cut by the cutter is wound on the one empty bobbin.

2. The web winding apparatus according to claim 1, wherein the web pressing members are formed so that the end portion of the web which has been fully wound on the other of the two bobbins is wound on the one bobbin which is empty.

3. A web winding apparatus comprising:

two bobbins on which a web is to be wound;

a cutter transferrable between the two bobbins and cutting the web to be transferred; and two web pressing members positioned at opposite sides of the cutter and swingable such that when one of the two web pressing members approaches the cutter, the other of the two web pressing members backs away from the cutter, the two web pressing members being transferrable together with the cutter between the two bobbins, wherein the two web pressing members are formed such that upon swinging, the two web pressing members move towards an empty one of the two bobbins positioned at one of the two web pressing members side which has been backed away from the cutter and upon swinging, the other of the two web pressing members which has approached the cutter presses an end portion of the web on the empty bobbin which has been cut by the cutter thereby to wind the end portion of the web on the empty bobbin, wherein two cutter receiving members are provided at respective sides in web transfer directions of the two web pressing members and swingable with the two web pressing members for cutting the web with the cutter by sandwiching the web giving a pressure together therewith.

4. The web winding apparatus according to claim 3, wherein web supporting members for supporting the web to be transferred are rotatably provided at respective sides of two pairs of the web pressing members and the cutter receiving members and swingable with the two pairs of the web pressing members and the cutter receiving members.

5. The web winding apparatus according to claim 4, wherein the two pairs of the web pressing members, cutter receiving members and the web supporting members are arranged to form a V-shape.

* * * * *